US006830199B1

(12) United States Patent
Jang

(10) Patent No.: US 6,830,199 B1
(45) Date of Patent: Dec. 14, 2004

(54) RAIL FIXING CLIP

(75) Inventor: Young Gil Jang, 1-304 Dongmyung Villa, 4781-1 Sujin-2 dong, Sujung-gu, Sungnam, Kyunggi-do 462-182 (KR)

(73) Assignees: Young Gil Jang, Kyunggi-do (KR); Gye Jun Lee, Seoul (KR)

( * ) Notice: Subject to any disclaimer, the term of this patent is extended or adjusted under 35 U.S.C. 154(b) by 0 days.

(21) Appl. No.: 10/111,466

(22) PCT Filed: Nov. 17, 2000

(86) PCT No.: PCT/KR00/01324

§ 371 (c)(1),
(2), (4) Date: Apr. 23, 2002

(87) PCT Pub. No.: WO01/36747

PCT Pub. Date: May 25, 2001

(30) Foreign Application Priority Data

Nov. 18, 1999 (KR) ..... P 1999-51384

(51) Int. Cl.[7] ..... E01B 13/00
(52) U.S. Cl. ..... 238/310; 238/349
(58) Field of Search ..... 238/310, 264, 238/315, 323, 238, 340, 352, 351, 349, 343, 284, 338

(56) References Cited

U.S. PATENT DOCUMENTS

| | | | | | |
|---|---|---|---|---|---|
| 4,119,271 | A | * | 10/1978 | Campbell | 238/336 |
| 4,275,832 | A | * | 6/1981 | Kenyon | 238/310 |
| 4,470,543 | A | * | 9/1984 | Gray et al. | 238/341 |
| 4,566,631 | A | * | 1/1986 | Brown | 238/349 |
| 4,715,534 | A | * | 12/1987 | Fee | 238/349 |
| 4,718,604 | A | * | 1/1988 | Eisenberg et al. | 238/349 |
| 4,967,954 | A | * | 11/1990 | von Lange | 238/310 |
| 5,069,386 | A | * | 12/1991 | Duval | 238/349 |

FOREIGN PATENT DOCUMENTS

| | | | | | |
|---|---|---|---|---|---|
| GB | 2295178 | | | 5/1996 | |
| GB | 2295184 | A | * | 5/1996 | E06B/1/28 |
| JP | 5741901 | | | 3/1982 | |
| JP | 57-41901 | A | * | 3/1982 | E01B/9/34 |
| JP | 83-529 | A | * | 6/1983 | E01B/9/34 |
| JP | 8226415 | | | 9/1996 | |
| KR | 83529 | | | 6/1983 | |
| WO | WO 91/00391 | | * | 1/1991 | |
| WO | WO 9100391 | A1 | * | 1/1991 | E01B/9/30 |

OTHER PUBLICATIONS

Partial English Translation of JP 5741901 Dated Mar. 6, 1982.
Partial English Translation of KR 83–529 Dated Jun. 17, 1983.

* cited by examiner

*Primary Examiner*—Frantz F. Jules
(74) *Attorney, Agent, or Firm*—Ladas & Parry

(57) ABSTRACT

A rail fixing clip of a railway for fixing a rail of the railway with respect to a rail support has an insertion portion and a support portion. The insertion portion includes a hinge portion of a straight line rod shape and a couple-of-force portion extended from one end of the hinge portion and arranged in parallel with respect to the hinge portion above the hinge portion and inserted into an elongated hole of a fixing implement of the rail support. The support portion includes a co-working portion extended from the other end of the couple-of-force portion and arranged in parallel with respect to the couple-of-force portion above the couple-of-force portion and a pressing portion extended from the co-working portion and arranged in parallel with respect to the insertion portion at a certain horizontal distance below the co-working portion for thereby pressing the upper surface of the flange portion of the rail.

7 Claims, 12 Drawing Sheets

RAIL FIXING CLIP

BACKGROUND OF THE INVENTION

1. Field of the Invention

The present invention relates to a rail fixing clip of a railway for directly pressurizing a lower flange portion of a rail of a railway installed in a rail tie or in a concrete railway and tightly fixing to a tie or a rail support for thereby preventing an escape of a rail of a railway, and in particular to a rail fixing clip of a railway having a durability significantly enhanced in a state that more than two separated points are supported.

2. Description of the Background Art

A rail fixing clip of a railway is a formed of a curved steel used for fixing a rail of a railway. One end of the rail fixing clip is fixed to a tie or a rail support which supports the lower portion of the rail of the railway, and the other end of the same is arranged on an upper surface of the flange portion of the rail of the railway at a certain horizontal distance with respect to the one end of the same, so that a flange portion of a rail which receives a couple of force which is generated at a portion of a tie is supported by a reaction force generated in a tie (in the case of a railway which is constructed without a tie) based on an elastic transform by a weight of a train which moves along a rail between the rail supports of the railway for thereby fixing the rail to the tie.

FIG. 1 is a perspective view illustrating a rail fixing clip of a conventional railway, FIG. 2 is a cut-away disassembled perspective view of a railway having a rail fixed by a rail fixing clip, FIGS. 3A and 3B are front and side views illustrating a rail fixing clip of a conventional railway, and FIG. 4 is a cross-sectional view taken s along line 4—4 of FIG. 2.

As shown in FIG. 1, the conventional rail fixing clip is formed in an e-shape formed by curving a single rod and includes a straight line shape hinge portion 1*a* at an one end of the same, a couple-of-force portion 1*b* arranged in parallel at one side of the hinge portion 1*a*, and a pressing portion 1*c* extended from the couple-of-force portion 1*b*, detouring the hinge portion 1*a* and arranged in parallel with respect to the hinge portion 1*a* at a portion opposite to the couple-of-force portion 1*b*.

As shown in FIG. 2, in the conventional rail fixing clip 1 of the railway, the hinge portion 1*a* is inserted into a fixing hole 3*a* of the clip fixing plate 3 (herein after called as a plate) embedded in the tie 2 and is fixed to the plate 3 in such a manner that the pressing portion 1*c* is mounted on the flange portion 5*a* of the rail 5, and the opposite couple-of-force portion 1*b* is formed on the plate 3.

In the conventional rail fixing clip 1 of the railway, the plate 3 offsets the couple of force based on a reaction force R1 of a vertical direction applied with respect to the upper portion of the hinge portion 1*a* on an upper portion of the fixing hole 3*a* and a reaction force R2 of the vertical upper portion applied with respect to the lower portion of the couple of force 1*b* through the pressing portion 1*c* of FIG. 2 with respect to the flange portion 5*a* of the rail 5 which receives a couple of force based on the vertical weight of the train between two ties 2 for thereby maintaining a parallel state of the force and moment, so that the rail 5 is fixed to the tie 1 or the rail support. Namely, the couple of force which is generated in a tie due to a vertical weight of the train which moves between two ties (or rail supports) in a direction that the rail is separated is applied in a vertical upper direction with respect to the lower portion of the pressing portion 1*c* of the pressing clip 1, and a moment MF1 about a connection portion (portion A of FIG. 1) between the pressing portion 1*c* and the couple-of-force portion 1*b* as shown in FIG. 3*a* and a moment MF2 about the hinge portion 1*a* as shown in FIG. 3B are generated. As shown in FIGS. 3A and 3B, the to conventional rail fixing clip 1 has a reaction force R1 of the plate 3 applied in a vertical direction in the portion above the hinge portion 1*a*, and the tie 1 has a vertical upper direction reaction R2 applied with respect to the couple of force 1*b* through the plate 3. A resistance moment MR1 is applied about the connection portion A between the couple-of-force portion 1*b* and the pressing portion 1*c* based on the reaction force R1, and a resistance moment MR2 is applied about the connection portion A between the couple-of-force portion 1*b* and the pressing portion 1*c*, and a resistance moment MR3 is applied about the hinge portion 1*a* for thereby maintaining a parallel state between the force and moment, so that the rail 5 is not separated. The forces applied to each portion of the fixing clip are actually applied as a distribution weight. In the above operation, it is assumed that the forces are a concentration weight applied to the centers of each portion.

The parallel states of the force and moment between the conventional rail fixing clip and the rail flange may be expressed as follows.

$$F=R1+R2$$

$$MF1=MR1+MR2$$

$$MF2=MR3$$

However, in the conventional rail fixing clip, since a torsion stress is concentrated at a connection portion A between the pressing portion 1*c* and the couple-of-force portion 1*b* to which an axial moment MF1 and a horizontal direction moment MF2 are applied in maximum by the couple of force F in an axial direction from an applying point of the couple of force F or in a horizontal direction, the durability of the connection portion A is weak. Therefore, in the case that the conventional rail fixing dip is used, the fatigue stress of the connection portion of the rail fixing clip is accumulated due to a repeatedly applied impact weight of the train, and the connection portion may be damaged, so that the maintenance cost is increased. In addition, the elements of the train may be damaged due to the particles of the fixing clip which is cut and flies, so that a worker or train passenger may be damaged by the particles of the fixing clip.

SUMMARY OF THE INVENTION

Accordingly, it is an object of the present invention to provide a rail fixing clip of a railway capable of supporting more than two separated points with respect to a fixing implement fixed to a tie or a concrete railway for thereby decreasing a torsion stress concentration phenomenon at a certain portion and significantly enhancing a durability.

To achieve the above objects, there is provided a rail fixing clip of a railway for fixing a rail of a railway with respect to a rail support of a railway according to the present invention which includes an insertion portion including a couple-of-force portion of a straight line-shaped rod and a hinge portion extended from one end of the couple-of-force portion and arranged in parallel with respect to the couple-of-force portion above the couple-of-force portion, and a support portion including a co-working portion extended from the hinge portion at a certain horizontal distance in parallel with respect to the hinge portion and a pressing portion extended from the co-working portion and arranged in parallel with respect to the co-working portion below the co-working portion for pressing the upper surface of the flange portion of the rail of the railway.

A mounting portion is further mounted in the elongated hole in such a manner that a part of the hinge portion is sunk in the direction of the couple-of-force portion in the hinge portion.

The support portion and insertion portion are symmetric.

The support portion and insertion portion are arranged in the vertical direction.

The support portion and insertion portion has a certain slant angle in the opposite direction.

The slant angle of the support portion and the insertion portion is 45°.

The lengths of the couple-of-force portion and hinge portion are longer than the lengths of the co-working portion and the pressing portion.

To achieve the above object, there is provided a rail fixing clip of a railway for fixing a rail of a railway with respect to a rail support of a railway which includes an insertion portion including a hinge portion of a straight line rod shape and a couple-of-force portion extended from one end of the hinge portion and arranged in parallel with respect to the hinge portion above the hinge portion and inserted into an elongated home of the fixing implement of the rail support of the railway, and a support portion including a second co-working portion extended from the other end of the couple-of-force portion and arranged in parallel with respect to the couple-of-force portion above the couple-of-force portion, a first co-working portion extended from the second co-working portion and arranged in parallel with respect to the second co-working portion at a certain horizontal distance with the second co-working portion, and a pressing portion extended from the second co-working portion and arranged in parallel with respect to the co-working portion below the co-working portion for thereby pressing the upper surface of the flange portion of the rail of the railway.

To achieve the above object, there is provided a rail fixing clip of a railway for fixing a rail of a railway with respect to a rail support of a railway which includes an insertion portion including a hinge portion of a straight line rod shape and a couple-of-force portion extended from one end of the hinge portion and arranged in parallel with respect to the hinge portion above the hinge portion and inserted into an elongated hole of a fixing implement of the rail support of the railway, and a support portion including a co-working portion extended from the other end of the couple-of-force portion and arranged in parallel with respect to the couple-of-force portion above the couple-of-force portion and a pressing portion extended from the co-working portion and arranged in parallel with respect to the insertion portion at a certain horizontal distance below the co-working portion for thereby pressing the upper surface of the flange portion of the rail of the railway.

BRIEF DESCRIPTION OF THE DRAWING

The invention will be explained with reference to the accompanying drawings, wherein.

DETAILED DESCRIPTION OF THE PREFERRED EMBODIMENTS

Figure 1:
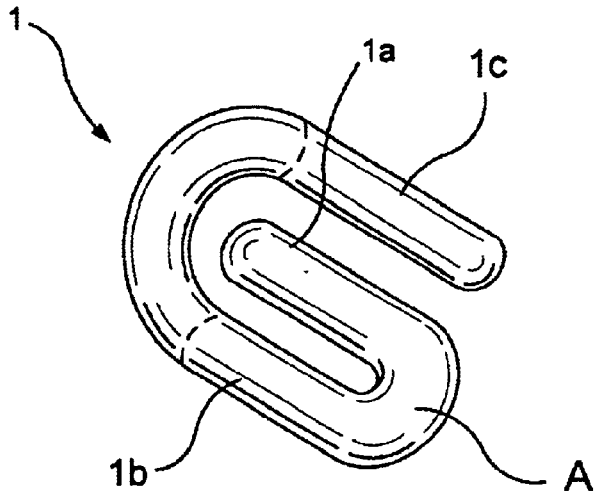
F I G. 1 PRIOR ART
FIG. 1 is a perspective view of a conventional rail fixing clip.
Figure 2:
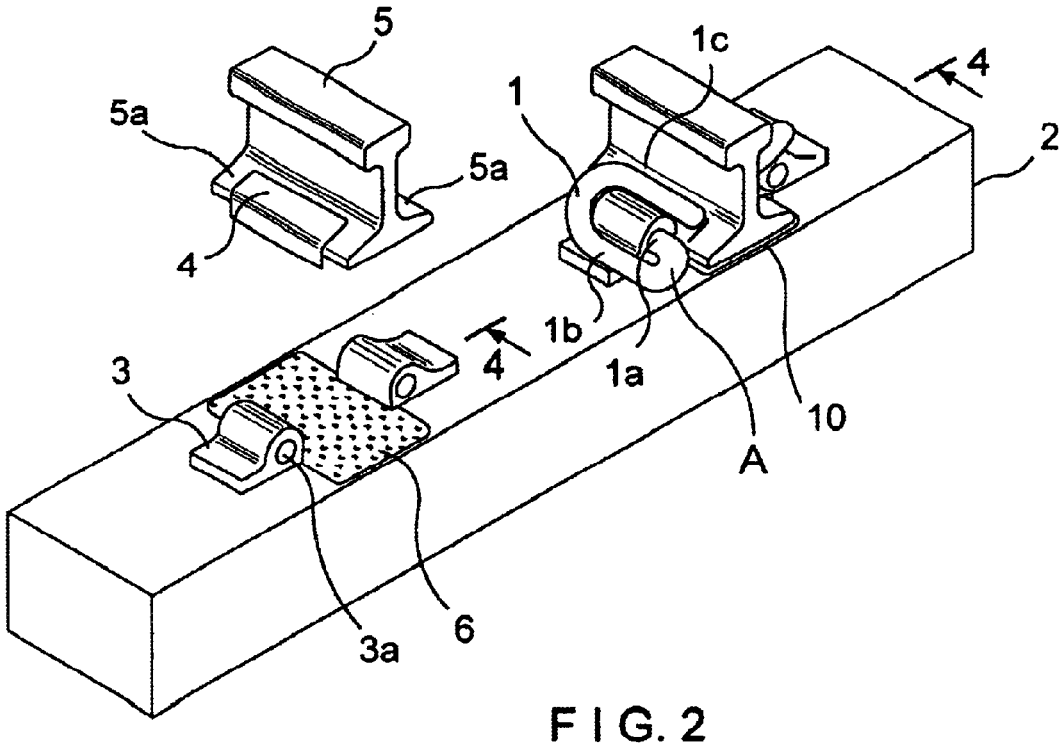
F I G. 2 PRIOR ART
FIG. 2 is a partly cut away and exploded perspective view of the conventional rail fixing clip of FIG. 1 in a railway.
Figure 3A:
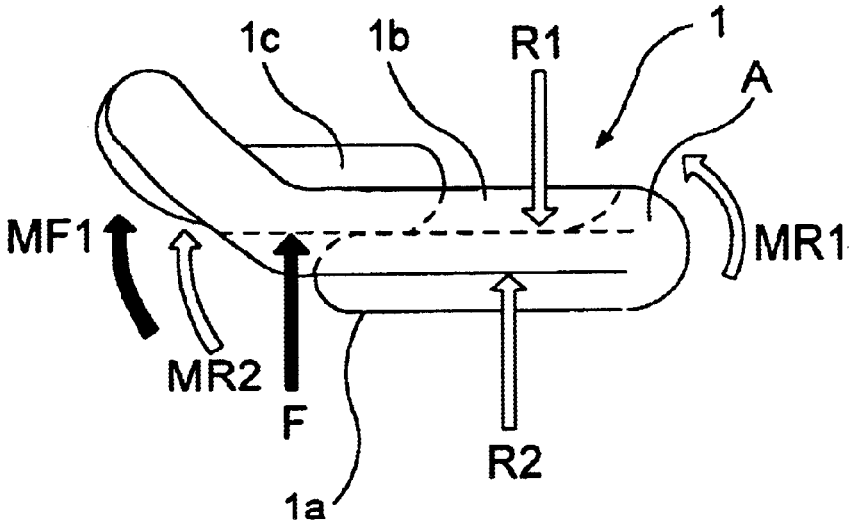
F I G. 3A PRIOR ART
FIGS. 3A and 3B are front and side elevational views of the conventional rail fixing clip of FIG. 1.
Figure 3B:
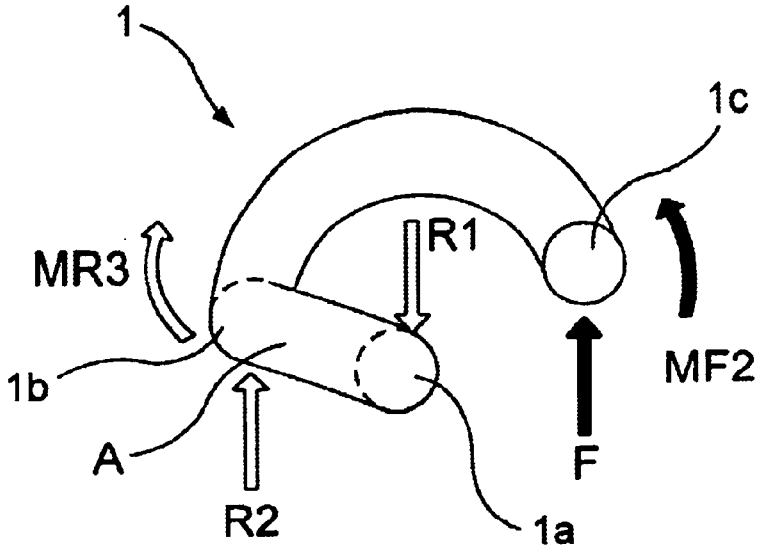
F I G. 3B PRIOR ART
Figure 4:
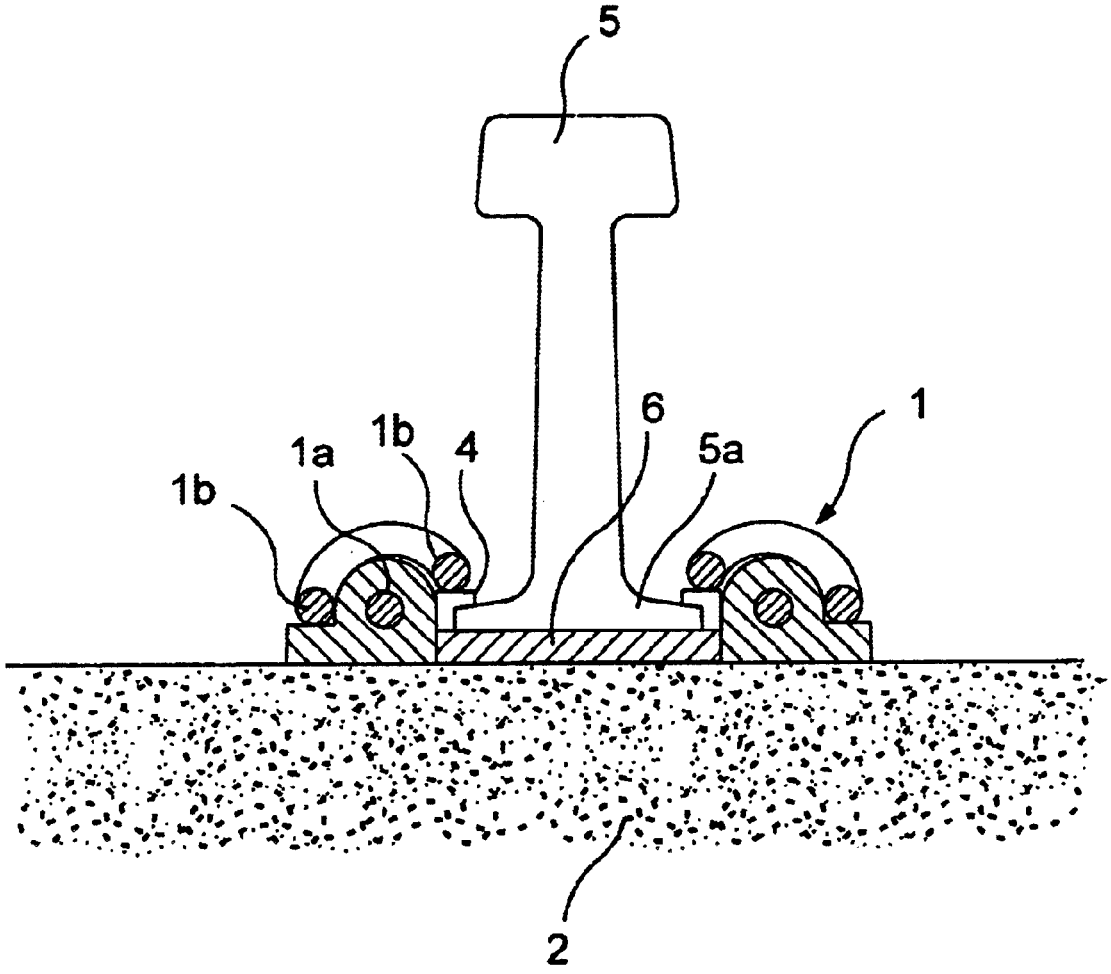
F I G. 4 PRIOR ART
FIG. 4 is a partly cut away, partly cross-sectional view along line 4—4 in FIG. 2.
Figure 5:
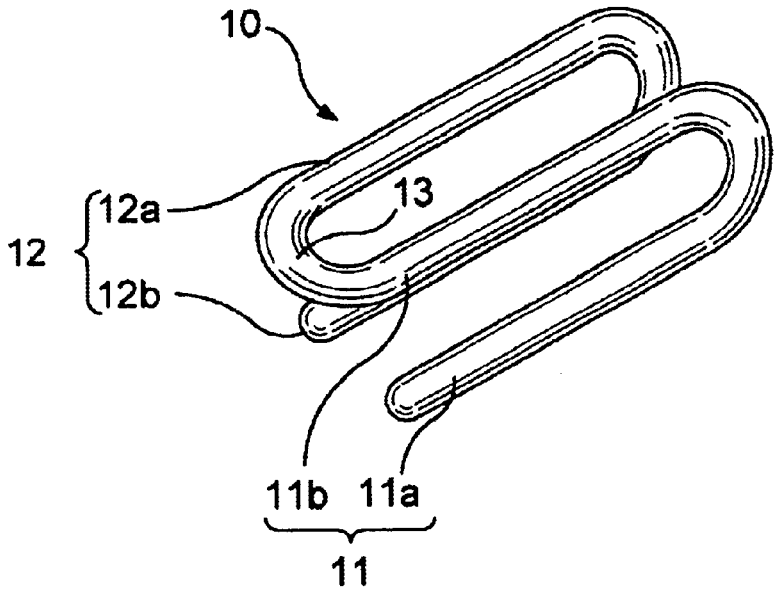
FIG. 5 is a top/front-end/right-side perspective view of a first embodiment of a rail fixing clip according to the invention.
Figure 6:
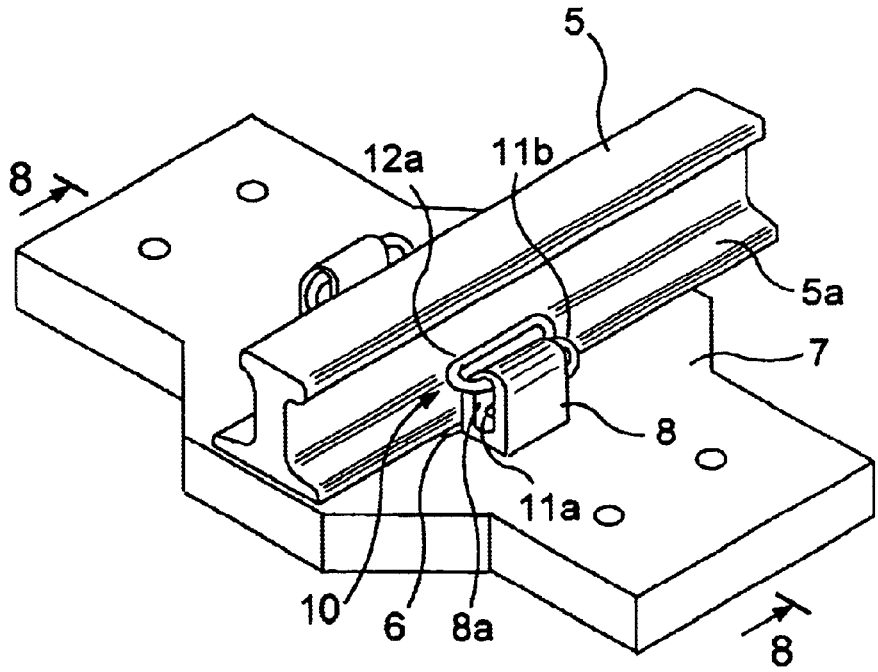
FIG. 6 is a top/front-end/right-side perspective view of the rail fixing clip of FIG. 5 in a state of use on a railway.
Figure 7A:
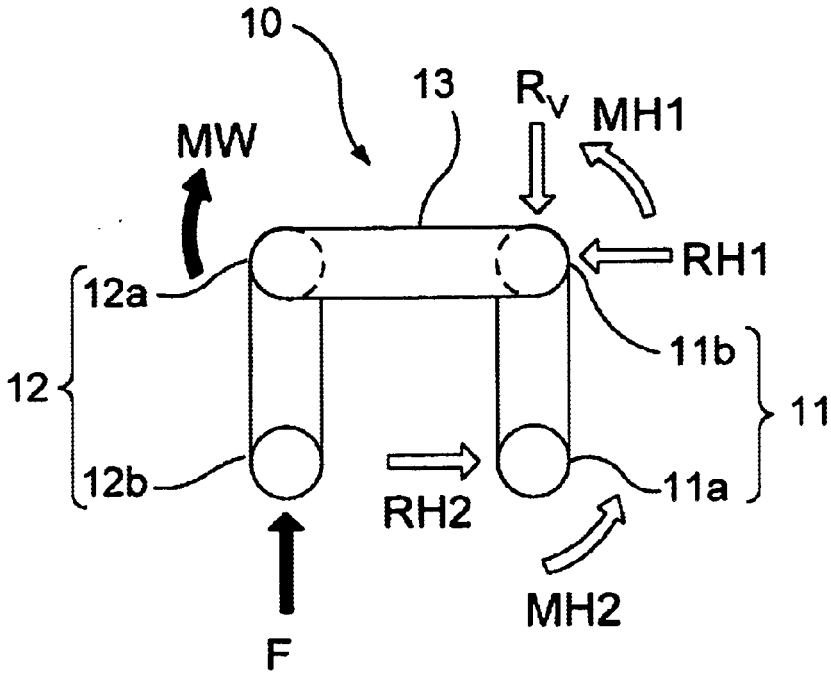
FIGS. 7A and 7B are side and top elevational and top views of the rail fixing clip of FIG. 5.
Figure 7B:
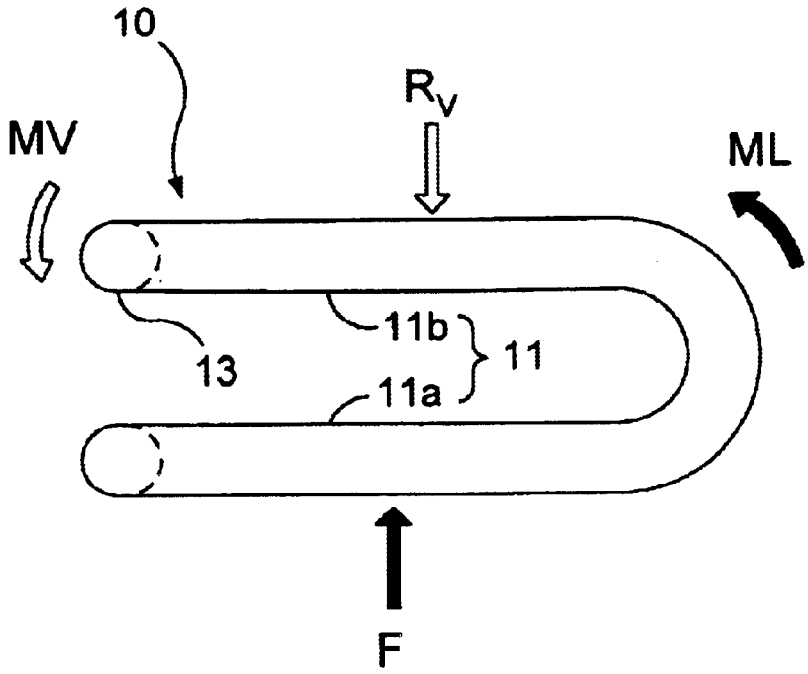
Figure 8:
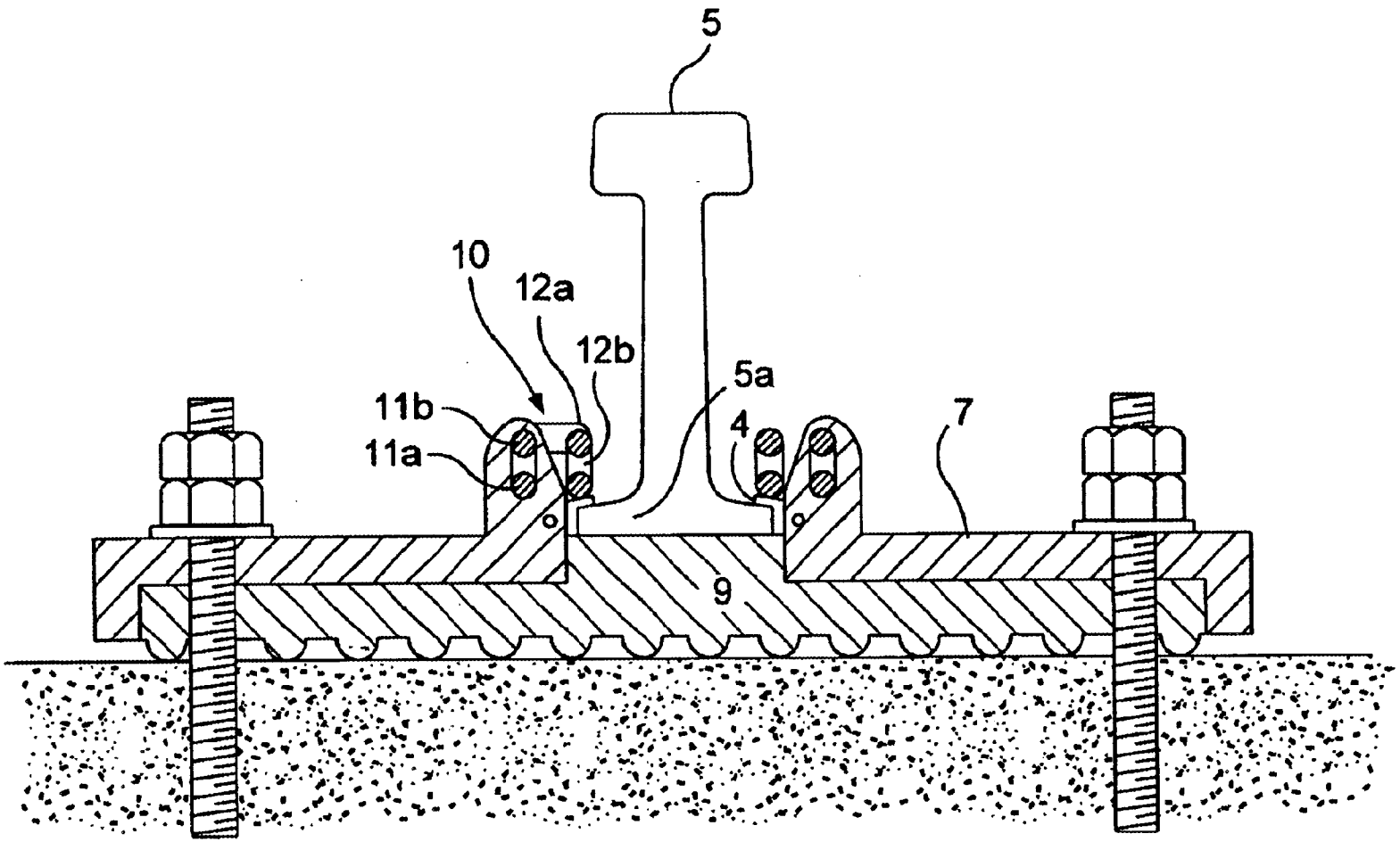
FIG. 8 is a front-end elevational view partly cross-sectional on line 8—8 in FIG. 6 of the rail fixing clip of FIG. 5 in the state of use of FIG. 6 when fixed on a bed.

FIG. 5 is a perspective view illustrating a rail fixing clip of a railway according to a first embodiment of the present invention, FIG. 6 is a view illustrating a using state of a rail fixing clip of a railway, FIGS. 7A and 7B are side views illustrating a rail fixing clip of a railway, and FIG. 8 is a cross-sectional view taken along line VIII—VIII of FIG. 6.

As shown in FIG. 5, a rail fixing clip 10 of a railway is a curved steel and includes U-shaped insertion and support portions 11 and 12 which are parallel each other. The insertion portion 11 includes a couple-of-force portion 11*a* of a straight line rod shape, and a hinge portion 11*b* extended from the couple-of-force portion 11*a* and arranged in parallel with respect to the couple-of-force portion 11*a* on the couple-of-force portion 11*a*. The support portion 12 includes a co-working portion 12*a* extended from the hinge portion 11*b* and arranged in parallel with respect to the hinge portion 11*b* at one side of the hinge portion 11*b*, and a pressing portion 12*b* extended from the co-working portion 12*a* and arranged in parallel below the co-working portion 12*a*.

As shown in FIGS. 6 through 8, in the rail fixing clip 10 of the railway according to the first embodiment of the present invention, a buffering plate 9 is installed on a concrete railway, and the pressing portion 12*b* of the support portion 12 is inserted into an elongated hole 8*a* of the fixing implement 8 of the rail support 7 in a state that the pressing portion 12*b* of the support portion 12 is placed on a flange portion 5*a* of the rail with respect to the rail support 7 fixed by an embedded bolt.

In the rail fixing clip of the railway according to the first embodiment of the present invention, the rail 5 of the rail support portion has a couple of force by a vertical weight of the train between two rail supports 8 and a repulsive force Rv as shown in FIGS. 7A and 7B in a vertical lower direction that the upper surface of the elongated hole 8*a* of the fixing implement 8 presses the hinge portion 11*b* through the pressing portion 12*b* with respect to the flange portion 5*a*, and resistance moments MH1 and MH2 are applied as horizontal repulsive forces RH1 and RH2 as shown in FIG. 7 with respect to an inner side of the hinge portion 11*b* and an outer portion of the couple-of-force portion 11*a* for thereby maintaining a parallel state between the force and moment, so that the rail 5 is tightly engaged with the rail support 7.

As shown in FIGS. 7A and 7B, when the couple of force by a vertical weight of a train which moves between the rail supports 8 is applied to the flange portion 5*a* of FIG. 6 of the rail, the couple of force is transferred to the pressing portion 12*b* of the rail fixing clip and generates a force F in a vertical upward direction for thereby lifting the fixing clip 10, and the force F is applied as a moment MW based on a horizontal distance between the pressing portion 12*b* and the insertion portion 11 and a moment ML about the connection portion 13 between the hinge portion 11*b* and the co-working portion 12*a* The fixing clip 10 according to the first embodiment of the present invention is elastically transformed in an elastic transformation limit and accumulates an elastic energy and receives a part of the force F and the moments MW and ML. The remaining force and moments are offset by a repulsive force RV that the fixing implement 8 having the fixing clip 10 applies with respect to the upper portion of the hinge portion 11*b*, the resistance moment MV based on the repulsive force RV, the repulsive forces RH1 and RH2 that the fixing implement 8 applies to the inner and outer sides of the couple-of-force portion 11*a*, and the resistance moments MH1 and MH2 based on the repulsive forces RH1 and RH2 for thereby maintaining a parallel state of the force. Therefore, it is possible to prevent the rail 5 which receives a couple of force F based on the weight of the train from being separated from the rail support 7 (or tie). In the railway, the rail 5 receives a couple of force F due to the weight of the train and a torsion weight when the train moves along the rail. In the present invention, since the torsion weight is weak, the effects of the same is not assumed.

The rail fixing clip 10 according to the first embodiment of the present invention stores the rising force F from the flange portion 5*a* of the rail 5 as an elastic transform energy and consumes the energy, and the fixing implement 8 offsets the forces as repulsive forces RV, RH1 and RH2 applied with respect to the fixing clip 10 for thereby supporting the rail 5. In particular, since the lenth from the end portion of the pressing portion 12*b* to the point in which the hinge portion 11*b* starts) is long, and the limit of the elastic transform is large, the size of the force which is stored as an elastic transform energy and consumed is large, and the moments MV, MH1 and MH2 generated in accordance with the rising force F of the rail is distributed to at least tree portions with respect to the fixing implement 8, namely, the upper portion of the hinge portion 11*b*, the inner side surface of the couple-of-force portion 11*a* and the outer side surface of the hinge portion 11*b*, it is possible to prevent the torsion stress due to the moment from being concentrated at a certain portion.

Since the rail fixing clip of the railway according to the first embodiment of the present invention has a structure having a large allowable strength and fatigue strength, the rail fixing clip of the rail has an excellent durability with respect to the conventional rail fixing clip of the railway assuming that the amount of the material used is the same. In addition, since the structure is symmetric, the rail fixing clip according to the first embodiment of the present invention is well adapted to the left and right sides of the rail and is fixed to the fixing implement 8 by simply inserting the support portion 12, so that the assembling performance is excellent, and the working efficiency of the railway construction and maintenance are significantly enhanced.

Figure 9:
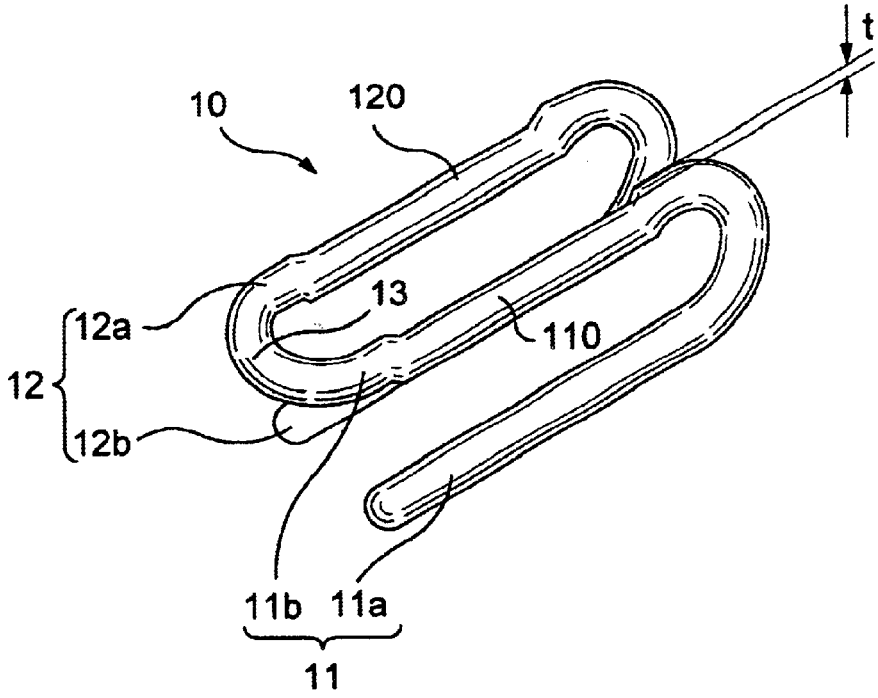
FIG. 9 is a top/front-end/right side perspective view of a second embodiment of a rail fixing clip according to the invention.
Figure 10:
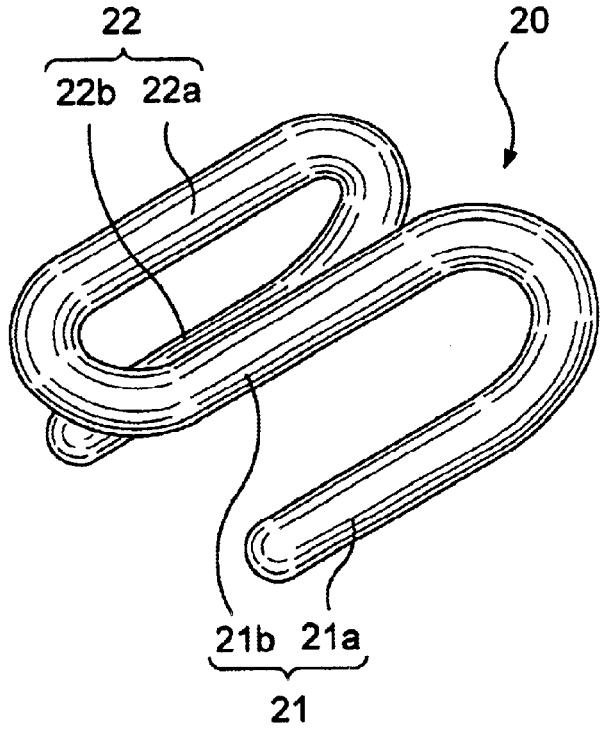
FIG. 10 is a top/front-end/right side perspective view of a third embodiment of a rail fixing clip according to the invention.
Figure 11:
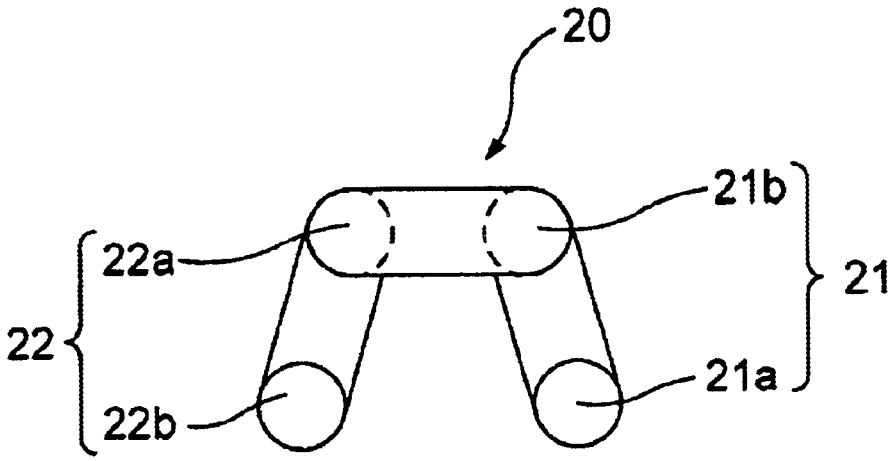
FIG. 11 is a front-end elevational view of the third embodiment of the rail fixing clip of FIG. 10.

As shown in FIG. 9, a second embodiment of the rail fixing clip 10 according to the invention includes mounting portions 110 and 120 having a step "t" in the vertical lower direction in the hinge portion 11*b* and the co-working portion 12*a*, when inserting into the elongated hole 8*a* of the fixing implement 8 of the rail support 7, the mounting portions 110 and 120 are received in the elongated hole 8*a* for thereby stably fixing to the fixing implement 8. FIG. 10 illustrates a third embodiment of the rail fixing clip of the invention. As shown in FIG. 11, the insertion portion 21 of the rail fixing clip 20 and the support portion 22 are slanted in the opposite direction. The slant angle is determined for implementing an easier assembling operation and adjusting a distance between the flange portion 5*a* and the fixing implement 8. The angle between the insertion portion 21 and the support portion 22 is in a range of 0° to 90°, preferably 45°.

Figure 12:
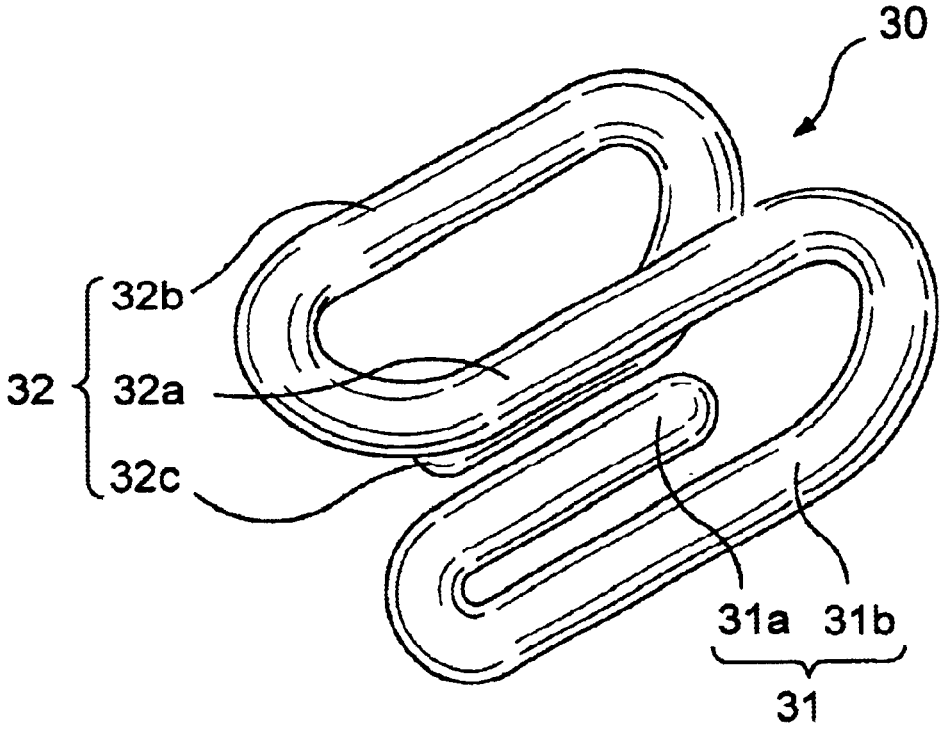
FIG. 12 is a top/front-end/right side perspective view of a fourth embodiment of a rail fixing clip according to the invention.

FIG. 12 is a view illustrating a fourth embodiment of the rail fixing clip of the present invention which includes an insertion portion 31 which includes a hinge portion 31*b* of a straight line rod shape and a couple-of-force portion 31*a* extended from one end of the hinge portion 31*b* and arranged in parallel with respect to the hinge portion 31*b* on the hinge portion 31*b*, and a support portion 32 which includes a second, co-working portion 32*a* extended from the other end of the hinge portion 31*b* by detouring the couple-of-force portion 31*a* and arranged in parallel with respect to the couple-of-force portion 31*a* on the I couple-of-force portion 31*a*, a first co-working portion 32*b* arranged in parallel with respect to the second co-working portion 32*a* at a certain distance with respect to the second co-working portion 32*a* in the horizontal direction, and a pressing portion 32*c* extended from the second co-working portion 32*b* and arranged in parallel with respect to the co-working portion 32*b* below the co-working portion 32*b*.

Figure 13:
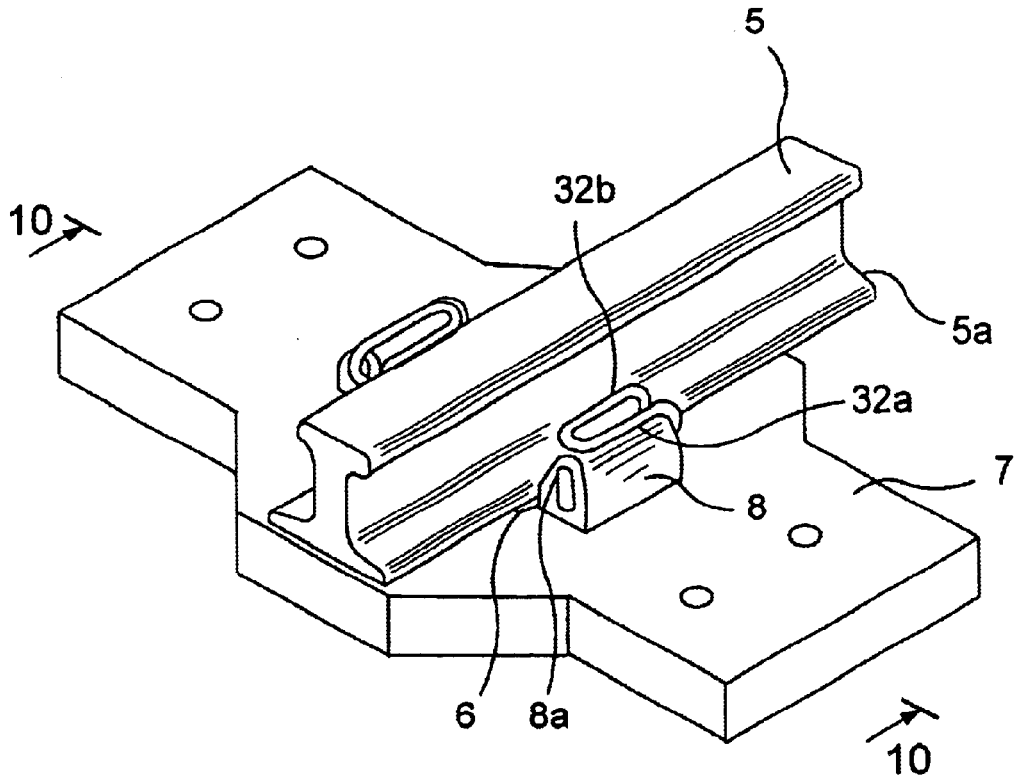
FIG. 13 is a top/front-end/right-side perspective view of the rail fixing clip of FIG. 12 in a state of use on a railway.
Figure 14:
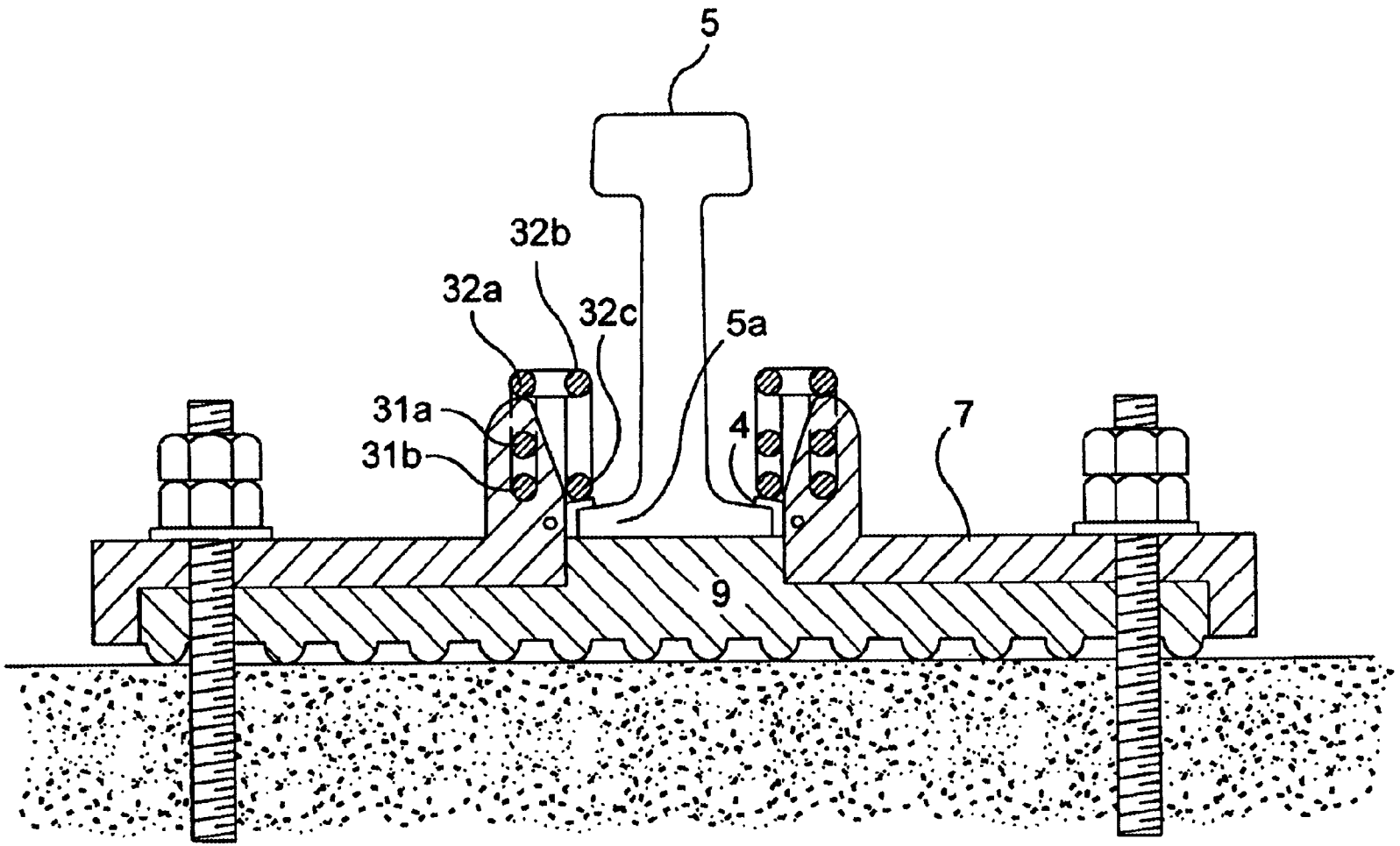
FIG. 14 is a front-end elevational view partly cross-sectional on line 10—10 in FIG. 13 of the rail fixing clip of FIG. 13 in the state of use when fixed on a bed.

As shown in FIGS. 13 and 14, in the rail fixing clip 30 of a railway according to a second embodiment of the present invention, an insertion portion having a hinge portion 31*b* and a couple-of-force portion 31*a* is inserted into an elongated hole 8*a* of the fixing implement 8 of the rail support 7 of the railway and presses the flange portion 5*a* of the rail 5 to which a couple of force is applied in a vertical upward direction based on a vertical weight of the train applied between the rail support 7. Namely, the resistance moments MH1 and MH2 of FIG. 7A are generated based on the repulsive force Rv of FIGS. 7A and 7B when the upper surface of the elongated hole 8*a* of the fixing implement 8 is applied to the couple-of-force portion 31*a* in the vertical downward direction and the horizontal repulsive forces RH1 and RH2 of FIG. 7A is applied with respect to an outer side of the couple-of-force force portion 31*b* and an inner side of the hinge portion 31*a* for thereby maintaining a parallel state between the force and moment, so that the rail 5 is tightly fixed to the rail support 7.

In the rail fixing clip 30 of the railway, the first and second co-working portions 32*b* and 32*a* between the pressing portion 32*c* which directly presses the flange portion 5*a* of the rail 5 and the hinge portion 31*b* are elastically transformed and adsorb a couple of force from the rail at a larger ratio and consume as the elastic transform energy. Therefore, the stress concentration is largely decreased at the hinge portion 31*b*, and the allowable strength is increased.

Figure 15:
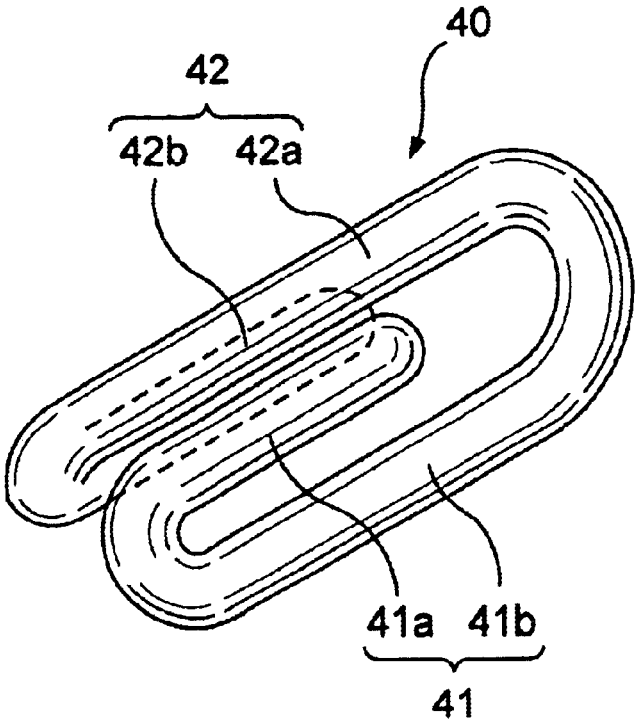
FIG. 15 is a top/front-end/right side perspective view of a fifth embodiment of a rail fixing clip according to the invention.
Figure 16:
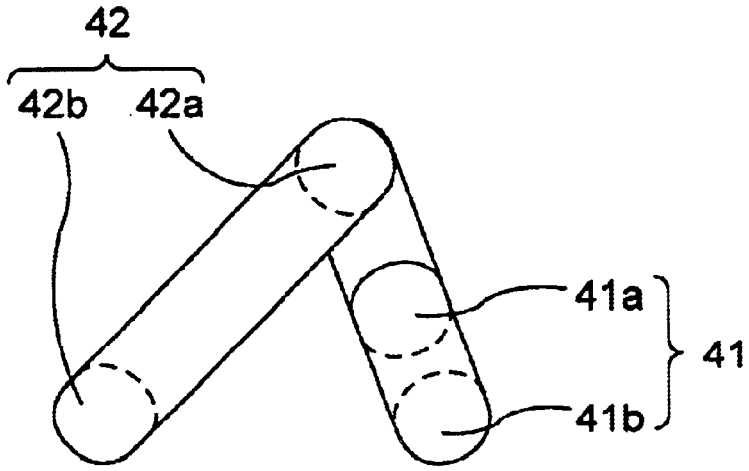
FIG. 16 is a front-end elevational view of the fifth embodiment of the rail fixing clip of FIG. 15.

FIG. 15 is a view illustrating a fifth embodiment of the rail fixing clip 40 of the present invention. In the case of the pressing clip 40, the second co-working portion 32*b* of FIG. 12 is removed. The insertion portion 41 includes a hinge portion 41*b* and a couple-of-force portion 41*a*, and the support portion 42 includes a co-working portion 42*a* extended from the other end of the couple-of-force portion 41*a* and arranged in parallel on the upper portion of the couple-of-force portion 41*a* and a pressing portion 42*b* extended from the co-working portion 42*a* and arranged in parallel below the co-working portion 42*a*. As shown in FIG. 16, the insertion portion 41 and the support portion 42 have the triangle cross sections.

In the rail fixing dip of the railway according to the second embodiment of the present invention, since the insertion portion 41 and the support portion 42 have a thrust cross section structure, it is possible to obtain a small size and a certain strength compared to the rail fixing clips of other embodiments of the present invention. Therefore, it is possible to decrease the consuming amount of the material, and the fabrication cost is low, and it is easy to carry and assembly based on a small volume.

Figure 17:
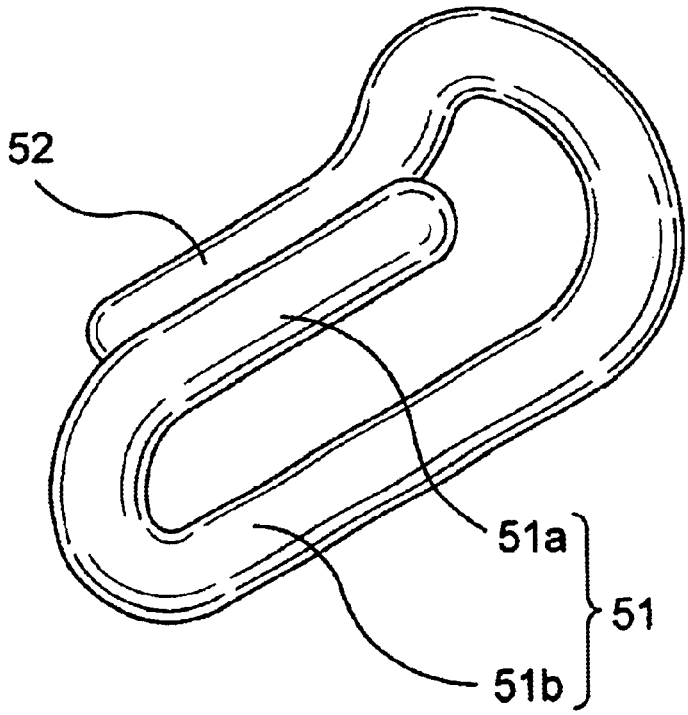
FIG. 17 is a top/front-end/right side perspective view of a sixth embodiment of a rail fixing clip according to the invention.
Figure 18:
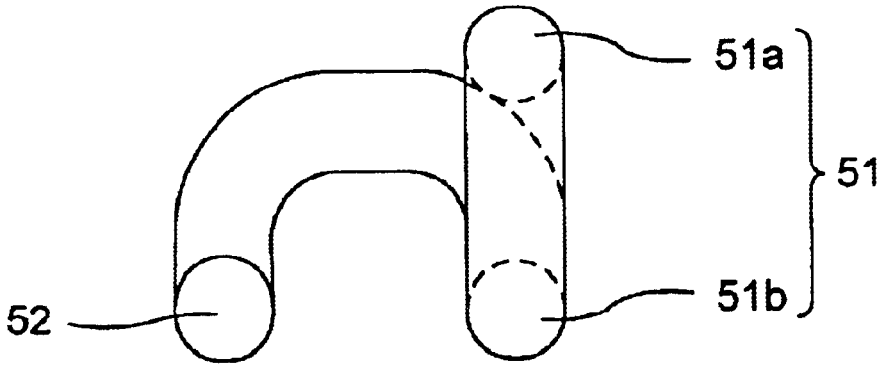
FIG. 18 is a front-end elevational view of the sixth embodiment of the rail fixing clip of FIG. 17.

FIGS. 17 and 18 are views illustrating a sixth embodiment of the rail fixing clip of the invention. In this case, the first and second co-working portions 32*a* and 32*b* of FIG. 12 are removed. Namely, the rail fixing clip includes a couple-of-force portion 51*a* and a hinge portion 51*b* which are parallel in the upper and lower portions and a pressing portion 52 extended from the hinge portion 51*b* and being parallel with respect to the hinge portion 51*b* for thereby forming a n-shaped structure as shown in FIG. 18.

The rail fixing clip of the railway according to the second embodiment of the present invention has a short total length from the couple-of-force portion 51*a* and the pressing portion 52. Therefore, the consuming amount of material is small, and the fabrication cost is decreased, and an easier carrying and assembling effect are obtained due to the small volume.

As described above, in the rail fixing clip of the railway according to the present invention, more than two separated points are supported with respect to the fixing implement fixed in the tie or the concrete railway, so that the torsion stress concentration phenomenon is decreased at a certain portion, and the durability is enhanced.

Therefore, in the case that the railway is constructed using the rail fixing clip according to the present invention, since the life span is long, it is possible to significantly decrease the maintenance cost of the railway and to prevent the rail from being damaged due to the damaged rail fixing clip by the accumulated fatigue due to the repeatedly applied impact weight of the train.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. In a rail fixing clip of a railway for fixing a rail of the railway with respect to a rail support, the improvements comprising:

an insertion portion including a couple-of-force portion of a straight line-shaped rod and a hinge portion extended from one end of the couple-of-force portion and arranged in parallel with respect to the couple-of-force portion above the couple-of-force portion;

a support portion including a co-working portion extended from the hinge portion at a certain horizontal distance in parallel with respect to the hinge portion and a pressing portion extended from the co-working portion and arranged in parallel with respect to the co-working portion below the co-working portion for pressing the upper surface of the flange portion of the rail of the railway; and a mounting portion mounted in an elongated hole in such a manner that a part of the hinge portion is sunk in a direction of the couple-of-force portion.

2. In a rail fixing clip of a railway for fixing a rail of the railway with respect to a rail support, the improvements comprising:

an insertion portion including a couple-of-force portion of a straight line-shaped rod and a hinge portion extended from one end of the couple-of-force portion and arranged in parallel with respect to the couple-of-force portion above the couple-of-force portion; and a support portion including a co-working portion extended from the hinge portion at a certain horizontal distance in parallel with respect to the hinge portion and a pressing portion extended from the co-working portion and arranged in parallel with respect to the co-working portion below the co-working portion for pressing the upper surface of the flange portion of the rail of the railway, wherein said support portion and insertion portion has a certain slant angle in the opposite direction.

3. The rail clip of claim 2, wherein said slant angle of the support portion and the insertion portion is 45°.

4. In a rail fixing clip of a railway for fixing a rail of the railway with respect to a rail support, the improvements comprising:

an insertion portion including a couple-of-force portion of a straight line-shaped rod and a hinge portion extended from one end of the couple-of-force portion and arranged in parallel with respect to the couple-of-force portion above the couple-of-force portion; and a support portion including a co-working portion extended from the hinge portion at a certain horizontal distance in parallel with respect to the hinge portion and a pressing portion extended from the co-working portion and arranged in parallel with respect to the co-working portion below the co-working portion for pressing the upper surface of the flange portion of the rail of the railway, wherein the lengths of the couple-of-force portion and hinge portion are longer than the lengths of the co-working portion and the pressing portion.

5. In a rail fixing clip of a railway for fixing a rail of the railway with respect to a rail support of the railway, the improvements comprising:

an insertion portion including a hinge portion of a straight line rod shape and a couple-of-force portion extended from one end of the hinge portion and arranged in parallel with respect to the hinge portion above the hinge portion and inserted into an elongated hole of a fixing implement of the rail support of the railway; and a support portion including a co-working portion extended from the other end of the couple-of-force portion and arranged in parallel with respect to the couple-of-force portion above the couple-of-force portion and a pressing portion extended from the co-working portion and arranged in parallel with respect to the insertion portion at a certain horizontal distance below the co-working portion for thereby pressing the upper surface of the flange portion of the rail of the railway.

6. The rail clip of claim 5 wherein said support portion and insertion portion are symmetric.

7. The rail clip of claim 5 wherein said support portion and insertion portion are arranged in the vertical direction.

* * * * *